US007237486B2

(12) United States Patent
Myers, Jr. et al.

(10) Patent No.: US 7,237,486 B2
(45) Date of Patent: Jul. 3, 2007

(54) LOW DEBRIS PERFORATING GUN SYSTEM FOR ORIENTED PERFORATING

(75) Inventors: William Myers, Jr., Spring, TX (US); Timothy Sampson, Spring, TX (US); James W. Reese, Spring, TX (US); Avigdor Hetz, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 80 days.

(21) Appl. No.: 10/821,075

(22) Filed: Apr. 8, 2004

(65) Prior Publication Data

US 2005/0235859 A1 Oct. 27, 2005

(51) Int. Cl.
*F42B 1/02* (2006.01)
*E21B 43/117* (2006.01)

(52) U.S. Cl. ..... 102/306; 102/476; 175/4.6; 89/1.15

(58) Field of Classification Search ..... 102/489, 102/476, 306, 307, 310, 492, 494, 308, 309; 89/1.15; 175/4.6; 166/55.2
See application file for complete search history.

(56) References Cited

U.S. PATENT DOCUMENTS 2,796,022 A * 6/1957 Delacour ..... 102/306
3,048,101 A * 8/1962 Lebourg ..... 175/4.6
3,282,354 A * 11/1966 Hakala et al. ..... 175/4.6
3,327,630 A * 6/1967 Bell ..... 102/306
3,444,810 A * 5/1969 Hakala ..... 102/310
3,965,993 A * 6/1976 Lavigne et al. ..... 175/4.6
3,991,836 A * 11/1976 Bouguyon et al. ..... 175/4.6
4,273,047 A * 6/1981 Rommer ..... 175/4.6
4,694,754 A * 9/1987 Dines et al.
4,784,061 A * 11/1988 Christopher ..... 102/306
4,794,990 A * 1/1989 Riggs ..... 102/306
4,832,134 A * 5/1989 Gill ..... 175/4.6
4,885,993 A * 12/1989 Hancock et al. ..... 102/307
5,460,095 A * 10/1995 Slagle et al. ..... 102/307
5,505,135 A * 4/1996 Fritz et al. ..... 102/307
6,386,109 B1 * 5/2002 Brooks et al. ..... 102/306
6,464,019 B1 10/2002 Werner et al.
2002/0189482 A1 * 12/2002 Kneisl et al. ..... 102/306
2005/0173118 A1 * 8/2005 Li et al. ..... 166/297

* cited by examiner

*Primary Examiner*—James S. Bergin
(74) *Attorney, Agent, or Firm*—Matt W. Carson; Keith R. Derrington

(57) ABSTRACT

Disclosed herein is a shaped charge assembly for use in a perforating gun. The shaped charge assembly includes a shaped charge combined with a longitudinal spine extending along a portion of a perforating gun barrel. The shaped charge can be secured to the spine with a retaining shell. A bushing is included between the outer radius of the casing the retaining shell. The bushing serves to absorb shock during detonation of the shaped charge and to help in orienting the shaped charges.

10 Claims, 1 Drawing Sheet

FIG.1
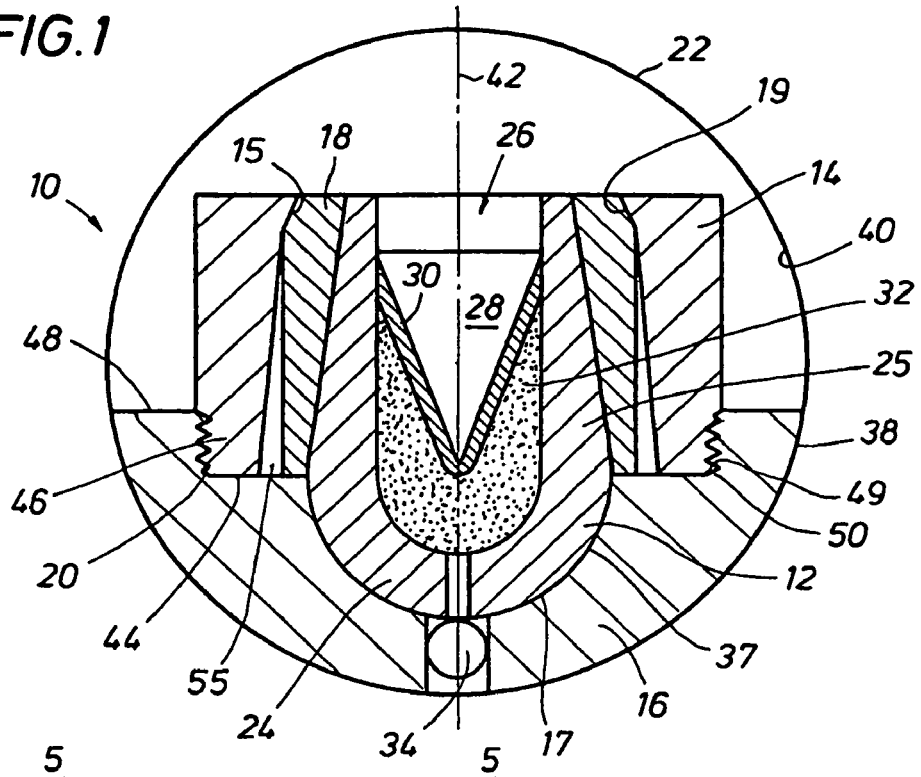
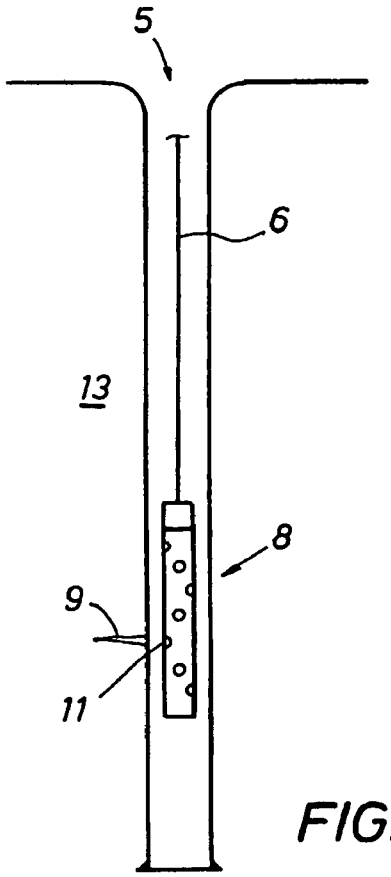
FIG.2
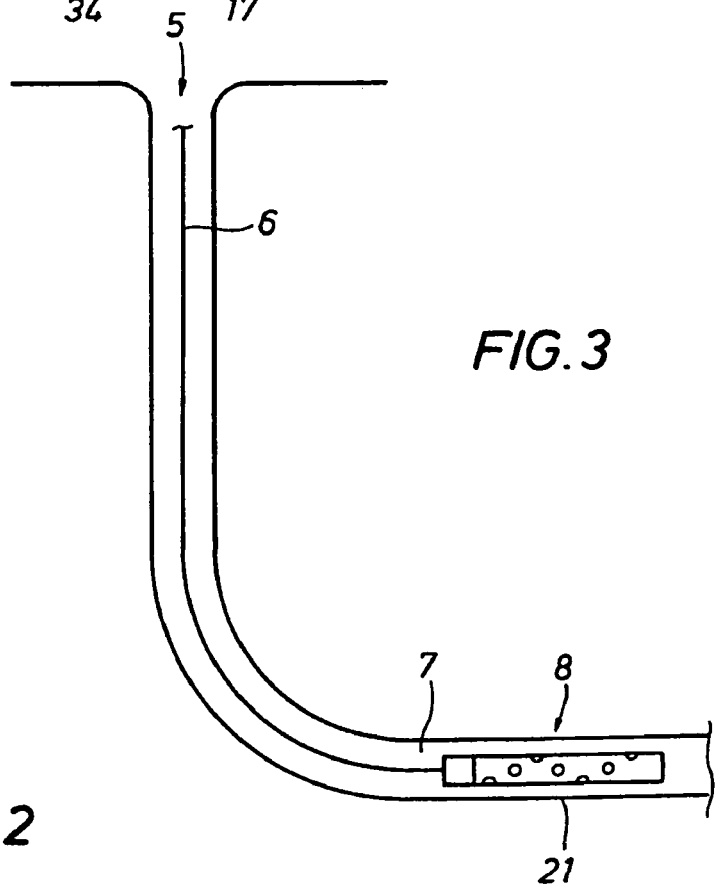
FIG.3

LOW DEBRIS PERFORATING GUN SYSTEM FOR ORIENTED PERFORATING

BACKGROUND OF THE INVENTION

1. Field of the Invention

This invention relates generally to the field of oil and gas production. More specifically, the present invention relates to a shape charged system having a reinforced casing that enhances the structural integrity of the casing thereby minimizing associated fracturing of the casing during detonation of the shaped charge.

2. Description of Related Art

Perforating guns are used for the purpose, among others, of making hydraulic communication passages, called perforations, in wellbores drilled through earth formations so that predetermined zones of the earth formations can be hydraulically connected to the wellbore. Perforations are needed because wellbores are typically completed by coaxially inserting a pipe or casing into the wellbore, and the casing is retained in the wellbore by pumping cement into the annular space between the wellbore and the casing. The cemented casing is provided in the wellbore for the specific purpose of hydraulically isolating from each other the various earth formations penetrated by the wellbore.

Included with the perforating guns are shaped charges that typically include a housing, a liner, and a quantity of high explosive inserted between the liner and the housing. When the high explosive is detonated, the force of the detonation collapses the liner and ejects it from one end of the charge at very high velocity in a pattern called a "jet". The jet penetrates the casing, the cement and a quantity of the formation.

Due to the high force caused by the explosive, the shaped charge often shatters into many fragments that exit the perforating gun into the fluids within the wellbore 5. These fragments can clog as well as damage devices such as chokes and manifolds, thereby restricting the flow of fluids through these devices and possibly hampering the amount of hydrocarbons produced from the particular wellbore 5. Therefore, there exists a need for an apparatus and a method for conducting perforating operations that reduces fragmentation of shaped charges and also provides a manner of retaining fragments of shaped charges produced during the perforation sequence.

BRIEF SUMMARY OF THE INVENTION

The present invention involves a shaped charge assembly comprising a casing for a shaped charge, the casing can have a generally tubular shape with open on one end and closed on the other. A base is formed on the closed end and walls extending away from the outer edge of the base terminating on the open end thereby forming a space on the inside of said walls and the base. The space should be capable of receiving an amount of explosive. Also included with the present invention is a spine disposed adjacent to the casing having a recess formed therein to receive the casing. The spine and recess can be capable of retaining substantially all of the casing fragments produced during detonation of the explosive. The shaped charge assembly of the present invention can further comprise a retaining shell releasably securable to the spine. The retaining shell should be coaxially circumscribing the casing when secured to the spine.

The shaped charge assembly can further comprise a first set of threads formed on the spine formed to mate with a corresponding second set of threads formed on the retaining shell. Further, a bushing can be included with the present invention that is coaxially disposed between the case and the retaining shell. The shaped charge assembly of claim 1, wherein the thickness of the walls decreases with distance from the base to the open end of the case. The thickness of the bushing can vary to accommodate varied orientations of the casing. Optionally, the present invention can include at least one other shaped charge assembly as well as a gun body capable of retaining the shaped charge assembly.

With regard to the gun body, the spine can extend along a portion of the length of the gun body, wherein the presence of the spine and the casing are capable of producing an asymmetric radial weight distribution around the axis of the gun body. Optionally, the edges of the base can be substantially curvilinear and the thickness of the base can exceed the thickness of the walls thereby producing a crucible shaped casing.

BRIEF DESCRIPTION OF THE SEVERAL VIEWS OF THE DRAWING

FIG. 1 depicts a cross sectional view of one embodiment of the present invention.

FIG. 2 illustrates one embodiment of the present invention within a wellbore.

FIG. 3 illustrates one embodiment of the present invention within a wellbore.

DETAILED DESCRIPTION OF THE INVENTION

With reference to the drawings herein, in FIG. 1 a cross sectional view of one embodiment of a shaped charge assembly 10 of the present invention is shown. The shaped charge assembly 10 of FIG. 1 comprises a case 12, a spine 16, a retaining shell 14, and a bushing 18. As is well known, when assembled these components are preferably positioned and used within a gun body 22. For the purposes of reference and not to serve as any limitation of the scope of the present invention, a dashed line is included with FIG. 1 representing an axis 42 of the shaped charge assembly 10. As will be described herein, it is preferred that many of the components of the shaped charge assembly 10 be bisected by the axis 42 in the embodiment of FIG. 1.

The case 12 is comprised a base 24 and walls 25, where the walls 25 are generally a tube-like section that extend up and away from the outer circumference of the base 24. The space 28 between the walls 25 and the base 24 is formed to receive explosive 32 and a liner 30. Preferably the base 24 is shaped similar to a bowl in that it has inner and outer surfaces that curve parallel to the axis of the base 24 as the surfaces travel away from the axis 42. The walls 25 and the base 24 meet approximately at the point where the inner surface of the case 12 is substantially parallel to the axis 42. It is also preferred that the thickness of the base 24 and the walls 25 be roughly the same at the region where they meet. However, the thickness of the walls 25 can decrease as the walls 25 approach the open end 26 of the case 12.

Rounding the outer surface of the base 24 combined with decreasing the thickness of the walls 25 results in a generally crucible shaped case 12, this enhances the fit between the case 12 and the recess 17 formed in the spine 16. Further, the generally curvilinear shaped of the base 24 also helps to equalize the forces that are subjected to the case 12, this helps to reduce fragmentation of the case 12 during detonation of the explosive. This shape also works to produce fragments that are more uniform in size. Both of these effects result in minimization of metal fragments escaping the gun body 22. However the present invention can accommodate a case 12 made from any one of a number of different shapes, such as one that has a largely rectangular cross section, a hemispherical shape, or a cross section where the inner and outer surface have different cross sections, such as an outer surface with a rectangular cross section and an inner surface having rounded edges, or vice versa.

As illustrated in a cross sectional view in FIG. 1, the spine 16 of one embodiment of the present invention has a generally curved outer surface 38 formed to fit a portion of the inner surface 40 of the gun body 22. Preferably the spine 16 should be somewhat hemispherical so that when situated within the gun body 22 its mass coupled with the base 24, retaining shell 14, and the bushing 18, will produce an eccentric moment of inertia around the axis of the gun body 22. While the outer surface 38 of the spine 16 has mostly the same radius along its circumference, the shape of the spine's 16 inner surface 37 varies along its circumference. The shape of the inner surface 37 surrounding and proximate to the axis 42 is largely curved and forms a recess 17. The shape of the recess 17 should closely match the shape of the outer surface of the base 24 such that a majority of the base 24 can be positioned within the recess 17.

A ledge 44 is positioned at the outer edge of the recess 17, the contour of the ledge 44 is primarily perpendicular to the axis 42. When viewed from the axis, the ledge 44 has a generally annularly shaped surface with a radius that extends from the terminal edge of the recess 17 up to the threaded portion 46. As can be seen in FIG. 1, the length of the ledge 44 should be able to accommodate the ends of both the retaining shell 14 and the bushing 18 when they are positioned coaxially around the case 12. The threaded portion 46 of the spine 16 is mostly parallel with the axis 42 having threads 49, such as National "N" threads, formed along its surface. The length of the threaded portion 46 will depend on the particular size of shaped charge assembly 10 involved as well as the type of threads used, but the length should be sufficiently long to ensure a tight and secure coupling of the threads 50 of the retaining shell 14 with the threaded portion 46. An annularly shaped shoulder 48 connects the inner surface 37 of the gun body 22 with the threaded portion 46. The shoulder 48 circumscribes the threaded portion 46 and preferably has a surface that is largely parallel to the surface of the ledge 44. However the shape and contour of the shoulder 48 is not critical, but can be any shape. The shoulder 48 though should have a large enough radius to provide sufficient material so that when the threads 49 are formed on the threaded portion 46 the spine 16 can still structurally support the addition of the retaining shell 14.

When viewed along the axis 42, the bushing 18 is has a mostly annular cross section. While the outer radius of the bushing 18 is preferably constant along its length, its inner radius can vary in size to match the contour of the outer radius of the casing 12. In the embodiment of the present invention shown in FIG. 1, the outer radius of the casing 12 decreases as it approaches the open end 26. Since it is desired that the inner radius of the bushing 18 closely circumscribe the outer surface of the casing 12, the inner radius of the bushing 18 is shown to correspondingly decrease proximate to the open end 26, while the outer radius remains relatively constant. Thus the thickness of the bushing 18 increases along its length from the ledge 44 towards the open end 26. However the shape of the inner radius is not limited to that shown in FIG. 1, but can be of any contour, but it should closely match the contour of the outer radius of the particular casing 12 included with the present invention—which as noted above can be of various types.

As previously noted, threads 50 on the outer circumference of one edge of the retaining shell 14 are included to mate with the threads of the threaded portion 46. The corresponding threads (49 and 50) provide a means of releasably attaching the retaining shell 14 to the spine 16, either by hand or with the aid of an associated tool. A retaining lip 15 is provided on the inner radius of the retaining shell 14 on the side opposite the threads 50. The retaining lip 15 extends inward towards the axis 42 from the inner radius of the retaining shell 14 having a surface that is generally at an angle oblique from the axis 42. Similarly, a beveled edge 19 is provided on the outer surface of the bushing 18 such that when the retaining shell 14 and the bushing 18 are assembled within the shaped charge assembly 10, the angle of the beveled edge 19 is substantially the same as the angle of the retaining lip 15. The combination of the retaining lip 15 and the beveled edge 19 provide a means of enabling the retaining the bushing 18 within the shaped charge assembly 10 when the retaining shell 14 is secured to the shaped charge assembly 10. It is believed it is well within the scope of those skilled in the art to design and implement adequate dimensions and angles for both the retaining lip 15 and the beveled edge 19 without undue experimentation.

It should be noted that the inner radius of the retaining shell 14 increases along its length such that its width is smaller proximate to its threaded end than proximate to the retaining lip 15. This increase in radius combined with a constant outer radius of the bushing 18 produces an annular void 55 between the bushing 18 and the retaining shell 14. As will be described in more detail below, the presence of the annular void 55 introduces shock absorption capabilities to the shaped charge assembly 10, thereby reducing fragmentation.

In operation of the preferred embodiment of the present invention, the shaped charge assembly 10 is assembled, then combined with a gun body 22, and integrated into a perforating gun 8. As is known in the art, the perforating gun 8 is inserted into a wellbore 5 preferably by a wireline 6. The perforating gun 8 can also be inserted into the wellbore 5 and lowered to the spot where perforations are desired. The perforating gun 8 can be tethered by a slickline, by tubing, or any now known or later developed insertion/suspension technique or devices. Once the surface personnel have determined that the perforating gun 8 has been lowered to the region where perforations are to be conducted, perforating operations can be commenced. Generally perforating is initiated by sending a signal down the wireline 6 from the surface to the perforating gun 8. As is well known, initiators (not shown) within the perforating gun 8 receive that surface signal and in turn transfer a detonative force though the detonation cord 34 that in turn initiates detonation of the explosive 32 within the shaped charge assembly 10. Detonation of the explosive 32 collapses the liner 30 and transforms the solid liner into a metal jet 11 that exits the wall of the gun body 22 and penetrates the inner surface of the wellbore 5. The metal jet 11 pierces the inner surface of the wellbore 5 thereby producing perforations 9 in the formation 12 that surrounds the wellbore 5.

During detonation of the shaped charge assembly 10 of the present invention the likelihood of fragments of the case 12 entering the wellbore 5 after detonation of the explosive 32 is highly reduced over prior art shaped charges. The improved size and shape of the case 12 combined with shock absorbing capabilities of the annular void 55 result in less fragmentation of the case 12. The annular void 55 can provide an air gap having shock absorbing qualities that greatly reduces the shock absorbed by the case 12. Providing alternate devices to absorb shock serves to decrease the shock realized by the case 12 thus reducing the fragmentation of the case 12. Furthermore, with regard to the fragmentation that does occur, the presence of the spine 16 combined with the retaining shell 14 serves to contain the fragments of the case 12 well within the gun body 22 and not allow them to enter the wellbore 5 where the fragments might likely cause clogging or congestion problems.

The spine 16 also can aid in orientation of the perforating gun 8 in which it is integrated. The eccentric loading of the spine 16 produces an asymmetric mass distribution axis (not shown) of the gun body 22. This is important when the perforating gun is in deviated section 7 of the wellbore 5, such that when allowed to rotate about its axis, the gravitational pull on the gun body 22 will attempt to orient it such that the spine 16 is located proximate to the lowermost portion 21 of the wellbore 5.

The components of the present invention should have the capability of withstanding downhole conditions, such as high pressures and temperatures, as well as the ability to withstand attach by corrosive agents. Accordingly steel is a suitable material for the components of the present invention.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. For example, other materials, such as rubber, elastomeric objects, foam, or other shock absorbing substances can be installed within the annular void 55. These and other similar modifications will readily suggest themselves to those skilled in the art, and are intended to be encompassed within the spirit of the present invention disclosed herein and the scope of the appended claims.

What is claimed is:

1. A shaped charge assembly comprising:

a casing having an open end and a closed end;

walls extending away from said closed end terminating on the open end; and a reinforcing system circumscribing at least a portion of said casing, said reinforcing system comprising a retaining shell coaxially circumscribing a portion of said casing and a bushing coaxially disposed between said casing and said retaining shell and wherein the inner surface of the bushing substantially circumscribes the outer surface of the casing walls.

2. The shaped charge assembly of claim 1, wherein said reinforcing system further comprises a spine.

3. The shaped charge assembly of claim 1 wherein the thickness of said walls decreases with distance from said closed end to the open end of said case.

4. The shaped charge assembly of claim 1 wherein the thickness of said bushing is variable to accommodate varied orientations of said casing.

5. The shaped charge assembly of claim 1 further comprising at least one other shaped charge assembly.

6. The shaped charge assembly of claim 5 further comprising a gun body capable of retaining said shaped charge assembly of said at least one other shaped charge assembly.

7. The shaped charge assembly of claim 1 further comprising a gun body, wherein the shaped charge assembly is disposed within the gun body to produce an asymmetric radial weight distribution about the axis of the gun body.

8. The shaped charge assembly of claim 1, wherein the edge of said closed end is substantially curvilinear and the thickness of said base generally exceeds the thickness of said walls thereby producing a crucible shaped casing.

9. The shaped charge assembly of claim 1, further comprising an annular void disposed between said retaining shell and said bushing.

10. The shaped charge assembly of claim 9, further comprising explosive disposed within said casing, wherein said annular void circumscribes a portion of said casing and is capable of absorbing energy resulting from detonation of the explosive.

* * * * *